US006370725B1

(12) United States Patent
Carlson

(10) Patent No.: US 6,370,725 B1
(45) Date of Patent: Apr. 16, 2002

(54) MOPS

(75) Inventor: Arthur Richard Carlson, Hawthron East (AU)

(73) Assignee: The Decor Corporation Pty. Ltd., Scoresby (AU)

( * ) Notice: Subject to any disclaimer, the term of this patent is extended or adjusted under 35 U.S.C. 154(b) by 0 days.

(21) Appl. No.: 09/402,187

(22) PCT Filed: Mar. 27, 1998

(86) PCT No.: PCT/AU98/00217

§ 371 Date: Oct. 1, 1999

§ 102(e) Date: Oct. 1, 1999

(87) PCT Pub. No.: WO98/44838

PCT Pub. Date: Oct. 15, 1998

(30) Foreign Application Priority Data

Apr. 4, 1997 (AU) ..... P0 5987

(51) Int. Cl.[7] ..... A47L 13/146

(52) U.S. Cl. ..... 15/119.2; 15/144.2; 15/244.2

(58) Field of Search ..... 15/116.2, 119.2, 15/144.2, 244.2

(56) References Cited

U.S. PATENT DOCUMENTS

| | | | | | |
|---|---|---|---|---|---|
| 2,670,488 | A | * | 3/1954 | Richards et al. | 15/119.2 |
| 2,801,433 | A | * | 8/1957 | Palma, Jr. et al. | 15/119.2 |
| 2,864,107 | A | * | 12/1958 | Greenleaf | 15/119.2 |
| 2,892,201 | A | * | 6/1959 | Peterson et al. | 15/119.2 |
| 2,959,799 | A | * | 11/1960 | Greenleaf et al. | 15/119.2 |
| 3,103,028 | A | * | 9/1963 | Richards | 15/144.2 X |
| 4,165,550 | A | * | 8/1979 | Burke | 15/144.2 |
| 4,312,092 | A | * | 1/1982 | Lundgren | 15/119.2 |
| 5,483,720 | A | * | 1/1996 | Decoopman et al. | 15/119.2 |

FOREIGN PATENT DOCUMENTS

| | | | | |
|---|---|---|---|---|
| AU | 39323/68 | * | 1/1970 | |
| DE | 2347667 | * | 4/1975 | |
| EP | 352542 | * | 1/1990 | |
| FR | 2229511 | | 12/1974 | |
| FR | 2492719 | | 4/1982 | |
| FR | 2640336 | | 6/1990 | |
| GB | 2088202 | * | 6/1982 | |
| GB | 2203932 | * | 11/1988 | |
| NO | 76184 | * | 1/1950 | 15/119.2 |
| SE | 302670 | * | 7/1968 | 15/119.2 |

* cited by examiner

*Primary Examiner*—Mark Spisich
(74) *Attorney, Agent, or Firm*—James Ray & Associates

(57) ABSTRACT

A mop is provided which has an elongate handle (3), a mop head (5), for carrying a squeezable mop material (13). The mop has arms (27, 29, 37, 39) which can be moved to effect squeezing of the mop material (13). The mop has a two axis swivel connector (7) which has two mutually perpendicular axis (57 and 59). The arrangement is such that the mop head (5) can be swung to various angular orientations relative to the handle (3) at the same time. A stop (56) is provided on the mop head (5) to act with the handle (3) when the arms (27, 29, 37, 39) are moved to effect squeezing, thereby allowing a squeezing force to be applied to the mop material (13).

15 Claims, 8 Drawing Sheets

105
107
15
117
125
123
129
56
73
75
78
57
77
7
45
83
9
41
43
51
53
121
109
81
119
13

MOPS

FIELD OF THE INVENTION

This invention relates to mops and relates particularly but not exclusively to synthetic foam head mops.

PRIOR ART

Hitherto, it has been known to provide mops with synthetic foam heads or similar material heads which can be squeezed. These mops differ from the traditional cotton thread mop. Many mops of this synthetic foam head type have been known in the past and some have incorporated mechanisms to assist squeezing of the mop. In one case, the mop head has a pair of wings which swing about an axis generally centrally of the mop handle in a direction which extends generally in the direction of pushing or pulling of the mop head by the mop handle. Such mop has a slideable collar which is fitted over the mop handle and pushing of the collar towards the mop head causes arm means to operate, to, in turn, swing the wings from an open position where they lie substantially co-plannar to a closed position where they are side-by-side and effect squeezing of the mop material.

Another known type of mop of this type has the mop head with a front portion and a rear portion relative to direction of pushing or pulling of the mop head by the mop handle. In this case, the front portion and rear portion are swingably connected together about an axis which extends transverse to the direction of pushing or pulling of the mop. A crank handle is provided on the mop handle which attaches with arm means to, in turn, cause swinging of the front portion and rear portion from an open co-plannar position to a closed side-by-side position to effect squeezing of the mop material.

In all cases, the mop handle has been either rigidly fixed to the mop head or alternatively there has been a single pivot axis connection between the mop handle and the mop head. Clearly, such mops are unable to allow the mop head to be angularly orientated relative to the handle to fit in awkward positions during mopping owing to either the rigid connection of the handle to the mop head or the single axis swivel connection of the handle to the mop head.

In some mops of the squeezing type, the mop head is made of a synthetics plastics material and has been provided with internal strengthening ribs which run parallel to each other. We have realised that with such mop heads when operated to squeeze the mop material by operation of a crank handle to cause swinging of the mop head from an open coplanar position to a closed position that insufficient torsional rigidity is provided in the mop head itself. This, in turn, means that the mop material is not squeezed adequately as the opposed faces of the mop material are squeezed greater at one side than on the other side.

Further, in the case of a mop where the mop head has a pair of wings which swing about an axis generally centrally of the mop handle in a direction which extends generally in the direction of pushing or pulling of the mop head by the mop handle, when the wings are swung to lie substantially side-by-side to permit squeezing of the mop material, the mop material in the region of swinging of the wings tends to bunch and provide an unnecessary bulk to the squeezing. This, in turn, requires excessive force to be applied to effect the swinging closing movement of the wings.

OBJECT AND STATEMENT OF THE INVENTION

It is an object of the present invention to attempt to overcome one or more of the aforementioned problems.

Therefore, according to a first broad aspect there may be provided a mop having an elongate handle, a mop head for carrying a squeezable sponge like pad mop material, said mop head being in a least two parts which can swing relative to one another so that in one swung condition the pad will be generally flat and unsqueezed and be useable as a mop, and in another swung condition so the pad will be squeezed, mop squeeze arm means carried said mop head for causing said two parts to swing together between said one swung condition and said another swung condition, there being a swivel connector interconnecting said mop head and said handle, said swivel connector having two mutually perpendicular swivel axis to enable said mop head to assume various angular orientations relative to said handle whilst said pad is engaged on a surface to be mopped, there being stop means for preventing swivel movement of said mop head relative to said handle past a particular orientation when said squeeze arm is operated to squeeze said mop pad thereby permitting pressure to be applied to said mop head by said squeeze arm means to effect swinging of said two parts and squeezing of said pad.

According to a second broad aspect of the present invention there may be provided a mop head having an elongated handle, a mop head carrying a squeezable sponge like mop material, said mop head having two wings supporting said mop material, each of said wings being separated by an intermediate mop head portion, said wings being swingable relative to said intermediate mop head portion about respective axis that extend along respective sides of said intermediate mop head portion, said axis being parallel to one another and extending in a direction of intended pushing or pulling of said mop head by said handle, the mop head being in a mop, in use, condition when the wings are open and generally co-plannar, and in a mop material squeezing condition when the wings are closed and side-by-side, spring means urging said wings to said co-plannar, in use, condition, a swivel connector attached to said intermediate portion and said handle maintaining said mop head connected to said handle, said swivel connector having two mutually perpendicular swivel axis to enable said mop head to assume various angular orientations relative to said handle whilst a mop face of said mop material is fully engaged on a surface to be mopped, said mop material being squeezable by operation of pushing a first squeeze arm towards said mop head, said first squeeze arm being retained at one end relative to said handle and being retained at the opposite end to a second squeeze arm, said second squeeze arm having a right hand arm and a left hand arm which respectively extend on the right hand side of said handle and the left hand side of said handle and pass over and contact tops of the corresponding wings of said mop head, said right hand arm and said left hand arm having respective end portions which are retained to said intermediate portion, said right hand arm, said left hand arm, and said end portions, acting to provide stops for said wings to maintain said wings in an open co-plannar position against the urging by said spring means, and when said first squeeze arm is pushed towards said mop head to cause pressure to be applied by said right hand arm and said left hand arm to the tops of the respective wings against the urging of the spring means to close said wing means to enable squeezing of said mop material, said first squeeze arm having a first pivot axis where it is retained to said handle, said second squeeze arm having a second pivot axis where said end portions are retained to said intermediate portion, said first and said second pivot axis being generally parallel to one another, said first squeeze arm and said second squeeze arm having two mutually perpendicular swivel axis connections where they are retained to each other, one of those axis being generally parallel to said first and said second pivot axis, the various axis being such that said right hand arm and said left hand arm and said end portions will hold the wings substantially co-plannar regardless of the possible angular orientations assumed by the mop face to said handle.

It is particularly preferred that said end portions of said right hand arm and said left hand arm be retained to said intermediate portion at a position forward of connection of said swivel connector, relative to the direction of pushing of said mop head when the mop head is orthogonal to the longitudinal axis of the handle.

It is also particularly preferred that said first squeeze arm be retained to said handle by a collar which is slideably carried on said handle, so that pushing or pulling said collar along said handle towards or away said mop head will cause corresponding pushing or pulling of said first squeeze arm to effect respective closing or opening of said wings.

It is also particularly preferred at least one of said first pivot axis, said second pivot axis, said one of said two axis connections of said first squeeze arm and said second squeeze arm, or the retaining connection where said end portions are retained to said intermediate mop head portion and allow relative rotation of said end portions relative to said intermediate position have a frictional component for swinging which will act against cranking forces tending to lift a front edge or a rear edge of the mop material from a surface which is being mopped as a result of pushing or pulling of the mop head by the mop head handle, thereby attempting to maintain said mop surface substantially wholly in contact with said surface being mopped.

It is particularly preferred that the frictional component be at said one axis of said two axis connections of said first squeeze arm and said second squeeze arm.

It is also particularly preferred that said frictional component be at said one axis of said two axis connections of said first squeeze arm and said second squeeze arm, at said second pivot axis, and where said end portions are retained to said intermediate mop head portion.

According to a third broad aspect there may be provided a swivel connector for interconnecting, a mop head, or like head with a handle, said connector having a body part forming part of a swivel joint for co-operation with a corresponding mating part of that swivel joint.

said body part having a bore at one end which is internally screw threaded to screw threadably receive a screw threaded end of a handle.

said body part having two portions, one portion forming one side half of said bore and the other portion forming the other side half of said bore said connector having a collar externally fitted over the two portions adjacent the screw thread of said bore to hold said portions together, the connector being such that when said threaded end of said handle is tightly screw threaded into said bore it will radially outwardly move said portions into engagement with internal surfaces of said collar and assist in holding the handle screw fixed relative to the connector.

According to fourth broad aspect there may be provided a mop head for a foam mop material pad or like mop material pad said mop head having two wings for supporting said pad, each of said wings being generally rectangular in shape and separated by an intermediate mop head portion, said wings being swingable relative to said intermediate mop head portion about respective axis that extend along respective sides of said intermediate mop head portion, said axis being parallel to one another and extending in a direction of intended pushing or pulling of said mop head by said handle, the mop head being in a mop, in use, condition when the wings are open and generally co-plannar, and in a pad squeezing condition when the wings are closed and side-by-side, said mop head being of synthetic plastics material, each of said wings having a series of strengthening webs extending on an underside thereof so that the free end faces of said strengthening webs define a surface for engaging with said mop material, said webs being elongate, some extending perpendicular to said axis, some extending transverse to said axis, and some extending diagonally across opposite corners of each of said wings.

BRIEF DESCRIPTION OF THE DRAWINGS

In order that the invention can be more clearly ascertained an example of a preferred embodiment will now be described with reference to the accompanying drawings wherein.

DETAILED DESCRIPTION OF PREFERRED EMBODIMENT

Figures 1, 4, 5, 6:
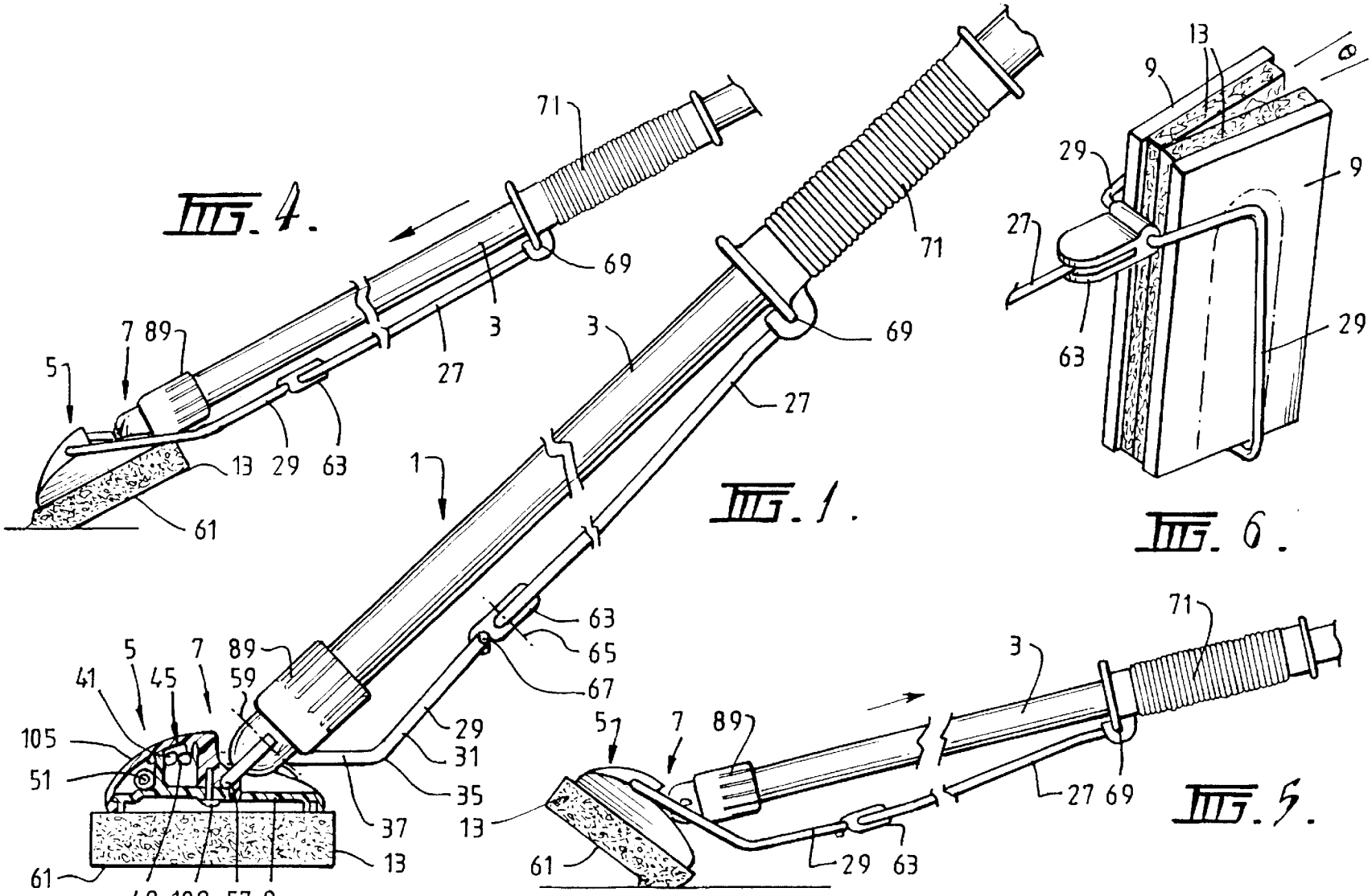
FIG. 1 is a side view of the example where the mop head is shown in part cross-section.
FIG. 4 is a side view of the mop showing cranking as a result of pushing the mop by the mop handle.
FIG. 5 is a view similar to that of FIG. 4 but showing opposite direction cranking as a result of pulling on the mop handle.
FIG. 6 is an isometric view of a prior art mop showing inadequate squeezing of the mop material due to torsional movement of the wings of the mop head.
Figure 2:
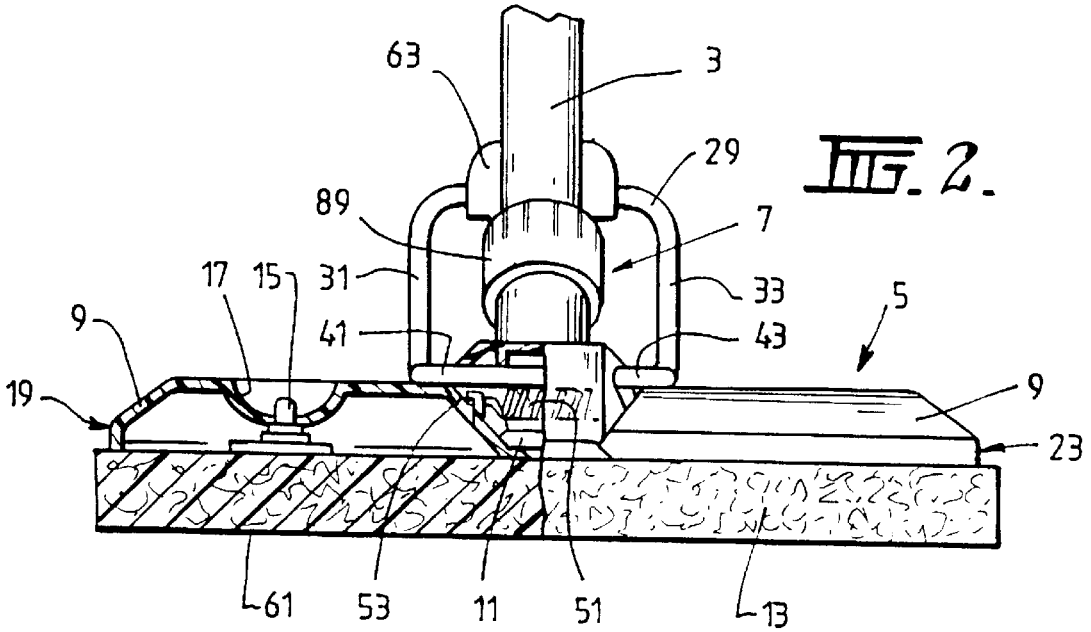
FIG. 2 is a front elevation of the mop head of the mop shown in FIG. 1 in part cross-section.
Figure 3:
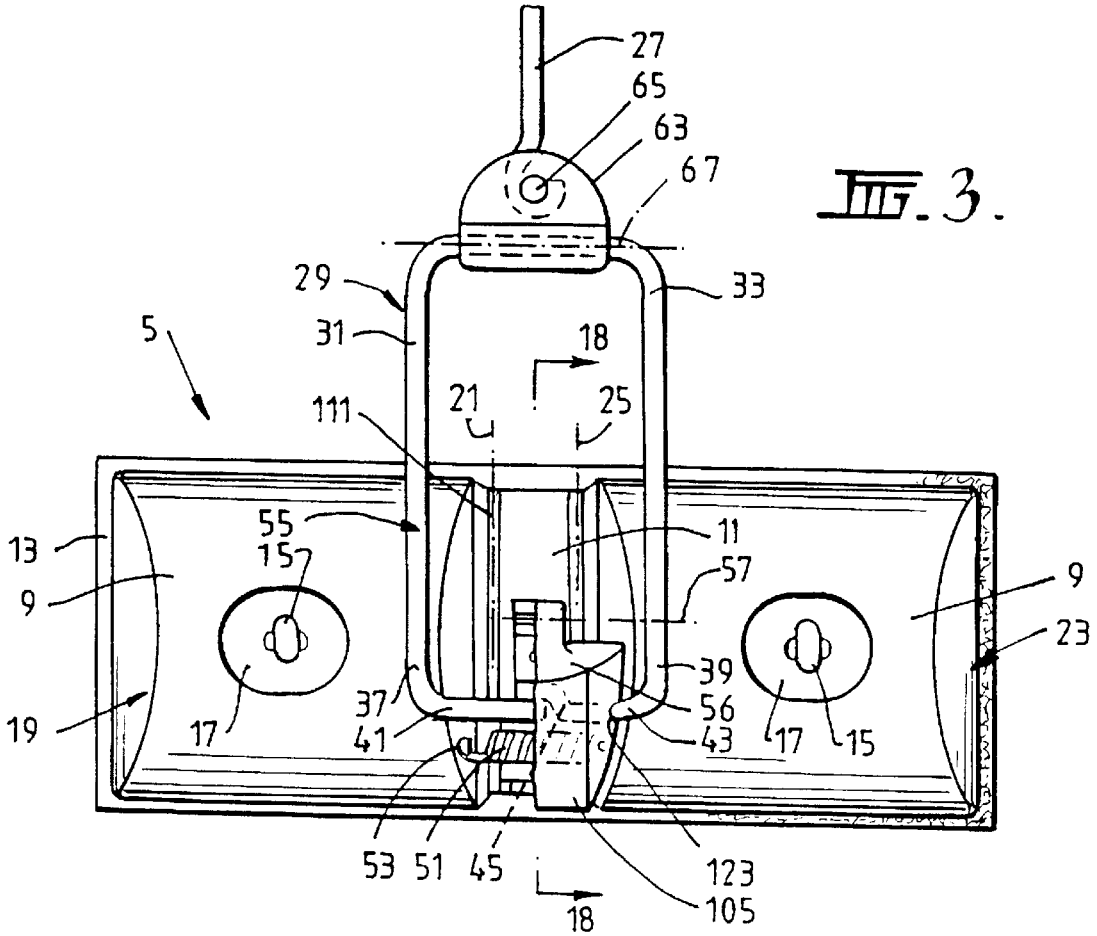
FIG. 3 is a plan view of the mop head.

Referring now firstly to FIGS. 1 through 3 it can be seen that there is provided a mop 1 having an elongate mop handle 3 and a mop head 5. The handle 3 may be of any convenient material such as wood, plastics or tubular steel. The transverse cross-section of the handle 3 is preferably round although other cross-sections are not excluded. A two axis swivel connector 7 connects the mop handle 3 to the mop head 5. The swivel connector 7 will be described in detail in due course.

The mop head 5 is of synthetic plastics material such as PVC and is of generally elongate rectangular shape and has a pair of wings 9 which connect with an intermediate mop head portion 11. By observing each of the FIGS. 1, 2 and 3 it can be seen that the wings 9 and the intermediate mop head portion 11 extend substantially co-plannar when in an, in use, mop position where the mop head is orthogonal to the longitudinal axis of the mop handle 3. This is the orientation depicted in FIGS. 1, 2 and 3.

A squeezable synthetic sponge mop material 13 such as of PVA is held to the mop head 5 by appropriate nuts or studs 15 (one on each of the wings 9) which locate within half hemispherical elongate recesses 17 formed in a top part of the wings 9. The arrangement is clearly shown in FIG. 3. The wing nuts or studs 15, in turn, connect with threaded studs which form an integral part of the mop material 13 for use on mops. The fitting of the mop material 13 to the mop head 5 is in a known manner used in existing mops.

The mop head 5 has each of the wings 9 able to swing about the side edges of the intermediate portion 11. Thus, a right hand wing 19 relative to a user standing behind the mop head 5 and holding the mop handle 3, can swing about an axis 21 (see FIG. 3), and the left hand wing 23 can swing about an axis 25. Thus, the wings 9 can swing from an open position where they lie substantially co-plannar to one another and also co-planner with the intermediate portion, to a closed position (shown in FIG. 9) where they lie substantially side-by-side and effect squeezing of the mop material 13. The hinged connection for swinging about the axis 21 and 25 can be effected by a respective groove 111 (see FIGS. 9, 10, 12, 13 & 14) and the resultant thinning of plastics material which forms the mop head 5. The techniques for providing hinging of plastics in this way are well known and will not be described further herein.

The wings 9 can be swung from the opened position to the closed position by operation of a first squeeze arm 27 which, in turn, can push against a second squeeze arm 29 (see FIG. 1). The second squeeze arm 29 has a right hand arm 31 and a left hand arm 33. These arms have a bend 35 (see FIG. 1) so that there is a right hand arm portion 37, and a corresponding left hand arm portion 39 which lie directly over the top of the respective right hand wing 19 and left hand wing 23. The portions 37 and 39 terminate with respective end portions 41 and 43. These portions 41, 43 also extend over the top of the right hand wing 19 and left hand wing 23. Each of the free ends of the end portions 41 and 43 are welded together as shown by region 45 in FIG. 3 only. The intermediate portion 11 has an upstanding post 47 comprising walls 113, 114, 115. The post 47 contains cut-outs 116 which provide a groove 49 in which the end portions 41 and 43 can be received (this is shown in FIG. 1 but in more detail in FIGS. 10 & 11). The region 45 locates within the body of the post 47 and in the groove 49 and retains the second squeeze arm 29 to the head 5 at the intermediate portion 11.

It should therefore be appreciated that in the positions shown in FIGS. 1, 2 and 3, the right hand arm portion 37, left hand portion 39, and end portions 41 and 43, act as stops for said wings to maintain the wings in an open co-plannar condition. Spring means 51 is provided to urge the wings 9 to the co-plannar position so that the respective right hand wing 19 and left hand wing 23 are stopped by the respective right hand arm portion 37 and end portion 41, and the left hand arm portion 39 and end portion 43. The spring means 51 is connected to upstanding posts 53 (see FIG. 10) moulded to the respective right hand wing 19 and left hand wing 23. The spring means 51 therefore extends over the top of the intermediate portion 11 as shown in FIGS. 1, 2, & 3. Accordingly, when the wings 9 are closed so that they assume a side-by-side relationship, the spring means 51 is extended and applies a force to the respective wings 9 in a direction to swing them back against the stops. Thus, when the first squeeze arm 27 is pushed forwardly towards the mop head 5, forces will be applied through to the second squeeze arm 29 which will, in turn, cause the respective right hand arm portion 37 and left hand arm portion 39 to bear against the upper surface of the top of the mop head 5 at the respective wings 9 to, in turn, swing those wings to the closed position. In this condition the right hand arm portion 37 and left hand arm portion 39 bear against a rear portion of the respective wings 19 or 23 near the position shown by arrow 55 (see FIG. 3). Thus, in this position, a relatively downwardly directed force is applied to the mop head 5 as the second squeeze arm passes over the top of the rear of the wings 9. In other words, the spacing apart of the right hand arm portion 37 and left hand arm portion 39 remain constant and the rear portion of the mop head 5 passes between those arms. During this motion, there is relative rotation of the end portions 41 and 43 to the mop head 5. The axis of rotation is about the longitudinal axis of both end portions 41 and 43. Simultaneously with the above, the mop head will crank about a swivel axis 57 (to be described directly) so that the mop handle and the mop head are located by a stop 56 (see FIG. 1 and FIGS. 15 through 18). This stop 56 allows forces from the first squeeze arm to be applied to the wings 9 to cause them to swing to the closed side-by-side condition where the mop material is squeezed.

Figures 15, 16, 17, 18, 19, 20, 21:
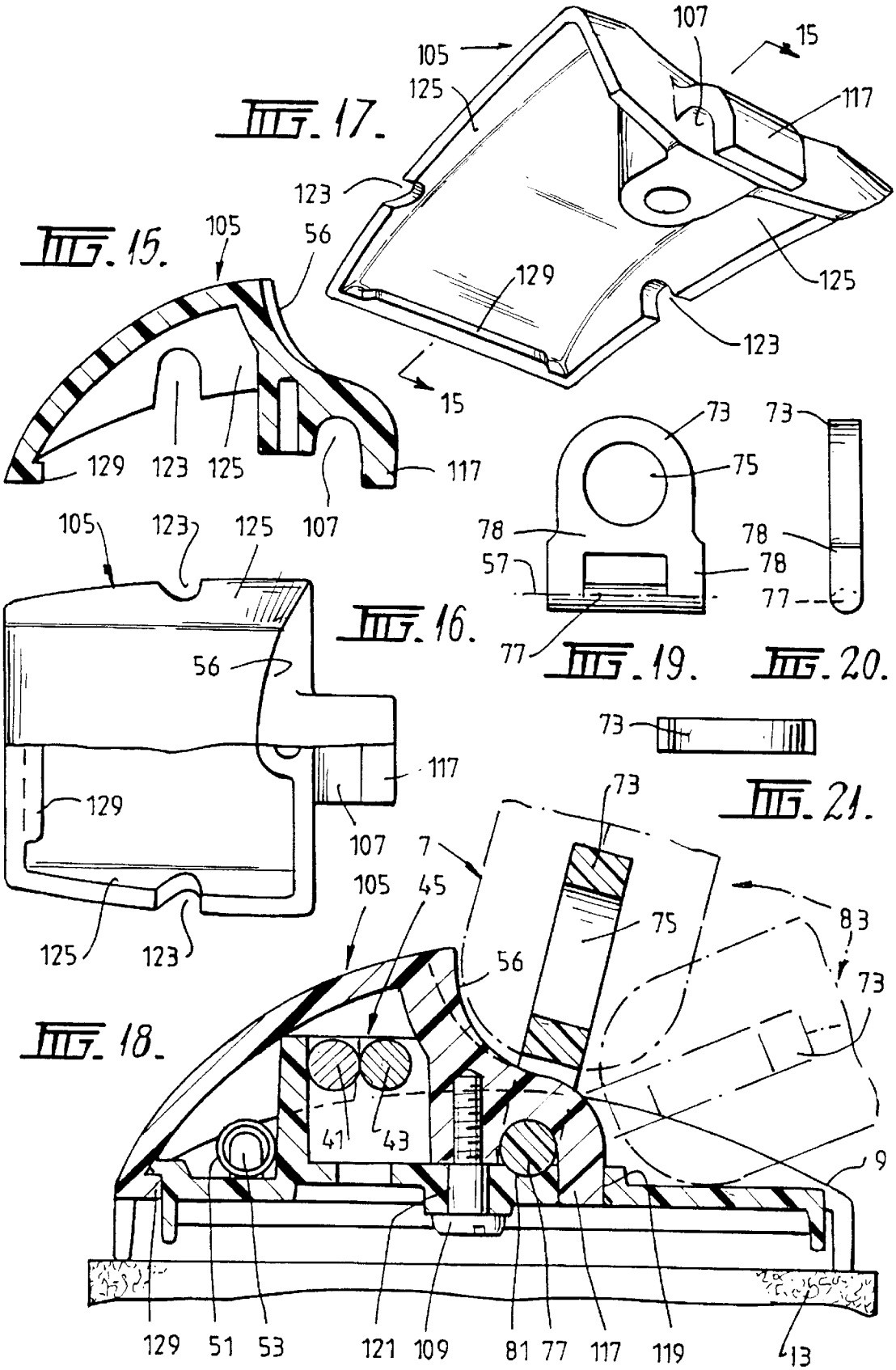
FIG. 15 is a transverse cross-sectional view of a cover for the intermediate part taken along section line 15—15 of FIG. 17.
FIG. 16 is a plan view in part section of the cover shown in FIG. 15 and FIG. 17.
FIG. 17 is an underneath isometric view of the cover.
FIG. 18 is a transverse cross-sectional view along section line 18 of FIG. 3.
FIG. 19 is a plan view of part of a swivel connector.
FIG. 20 is an end view of the part of the swivel connector shown in FIG. 19.
FIG. 21 is a top view of the part of the connector shown in FIG. 19.
Figure 22:
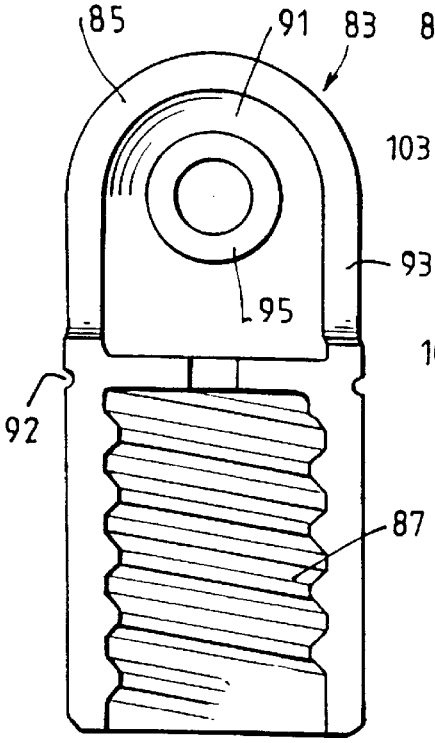
FIGS. 22 and 23 are a front view and a transverse cross-sectional view respectively of another part of the connector.
Figure 23:
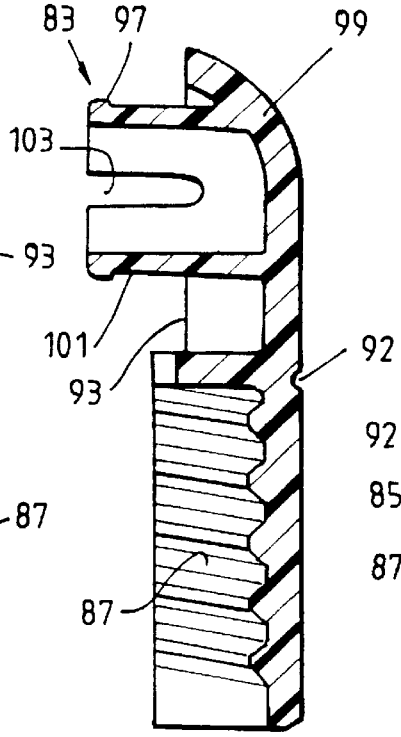

The swivel connector 7 has two mutually perpendicular swivel axes 57 and 59,(see FIG. 1 and FIG. 18). Thus, in use, the mop head 5 can assume various angular orientations relative to the mop handle 3 whilst a mop face 61 of the mop material 13 is engaged on a surface being mopped. Thus, it can be appreciated by viewing FIG. 1, that the handle 3 can move in an upward or downward direction or in a side to side direction about the swivel axes 57 and 59. The connection between the first squeeze arm 27 and the second squeeze arm 29 retaining those two arms together is such that this movement can occur. Thus, it can be seen that a connector 63 of suitable material such as plastics material has a first pivot axis 65 and a second pivot axis 67. For up and down swinging movement of the mop handle 3 the first squeeze arm 27 and the second squeeze arm 29 swing about the second axis 67. When the mop handle 3 swings from side to side, the first squeeze arm 27 and the second squeeze arm 29 swing about the first axis 65. During such movement, the second squeeze arm 29 does not move substantially relative to the mop head 5.

The first squeeze arm 27 is retained relative to the handle 3 about a swivel axis 69. The swivel axis 69 is on a collar 71 which is slideably received over the mop handle 3. Typically, the first squeeze arm is operated to push or pull by moving the collar 71 upwardly or downwardly of the mop handle 3.

Details of the connector 7 are shown in figures 19 through 27. The swivel connector 7 has a plate like first part 73 which is generally 'D' shaped which has a central opening 75 and an axle 77 supported by two arms 78. The axle 77 permits swinging of the first part 73 about axis 57. The axle 77 locates in a groove 81 provided in the intermediate portion 11.

The swivel 7 has a second part 83 which is formed of two halves 85 and 99. The first half 85 has a tubular body with a screw threaded half bore 87 into which a mop handle 3 can be threadably received. The external surface of the tubular body is inclined by a shallow taper angle such as of 1° or 2° to receive a collar 89 (see FIGS. 26 and 27). The body has a forward hemispherical shaped end 91 with a plannar dropped down face 93. It also has an upstanding hollow stud 95.

The second half 99 is almost identical to the first half 85 except that it has an upstanding hollow pivot axle 101 with a radially extending peripheral rim 97. The internal size of the hollow axle 101 is sufficient to receive the stud 95 on the first half 85. The combined dimensions of the dropped-down faces 93 on both halves is equal to the thickness of the plate like first part 73 when the two halves are brought together.

The fact that the stud 95 locates within the pivot axle 101 ensures that the two halves 85 and 99 align correctly. The stud 95 also provides support for the axle 101.

The axle 101 has two diametrically opposite longitudinal extending openings 103 which are provided to permit snap fitting of the first part 73 to allow the rim 97 to pass through the opening 75. Thus, when the rim 97 is passed through the opening 75, the first part 73 is retained located relative to the second part 83. The two halves 85 and 99 are then joined together by the hollow collar 89 which is tightly slideable over the externally shallow tapered body of the tubular bore 87. The collar 89 has an internal raised rib 90 at its forward end and this is arranged to snap lock into a circumferentially extending groove 92 on the two halves 85, 99 near the bottom of the hollow body.

Figure 27:
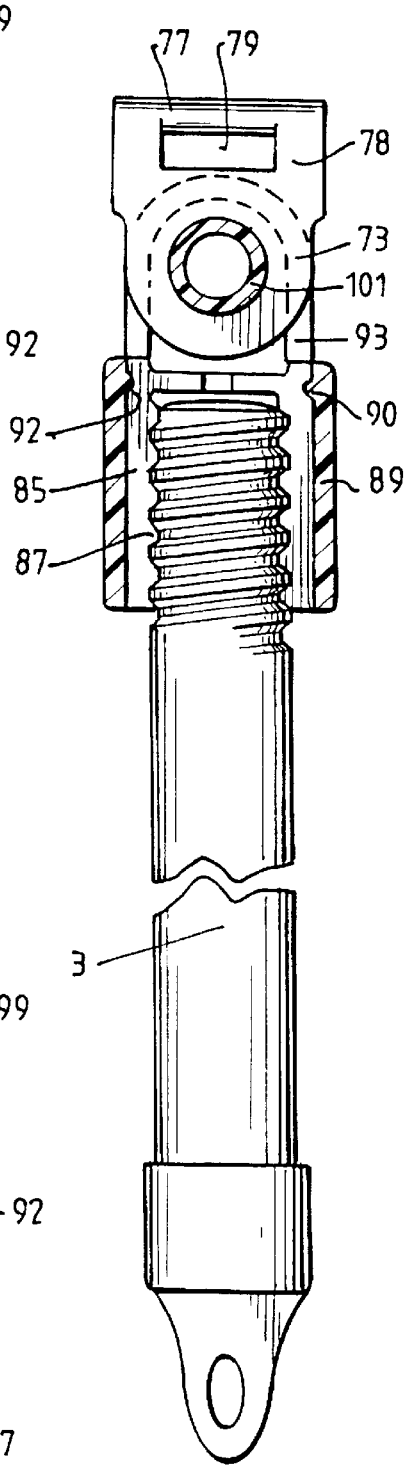
FIG. 27 is a transverse cross-sectional view of the parts of the connector interfitted with a mop handle.
Figure 24:
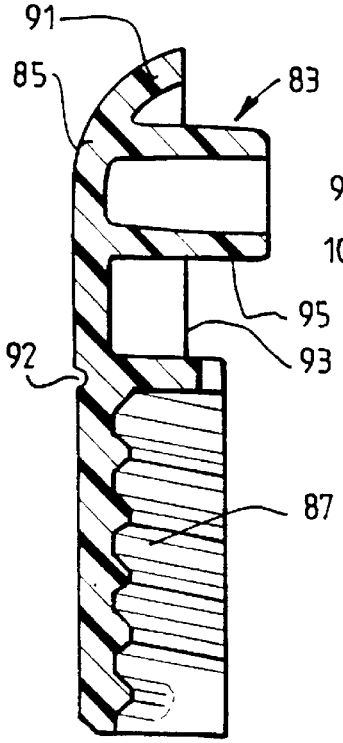
FIG. 24 and FIG. 25 are transverse cross-sectional views of the connector parts shown in FIGS. 22 and 23.
Figure 25:
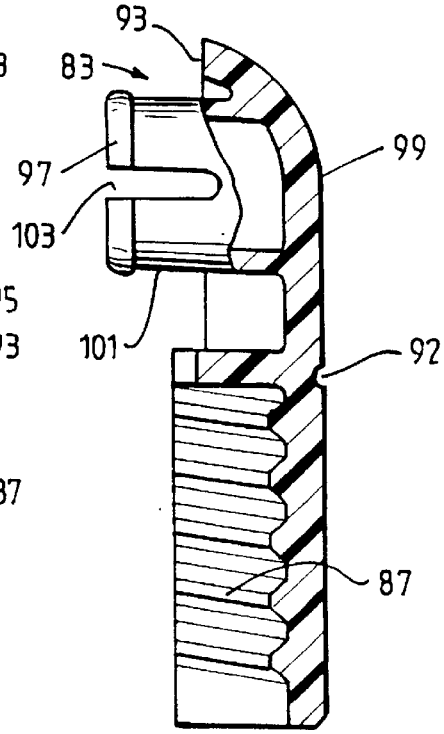
Figure 26:
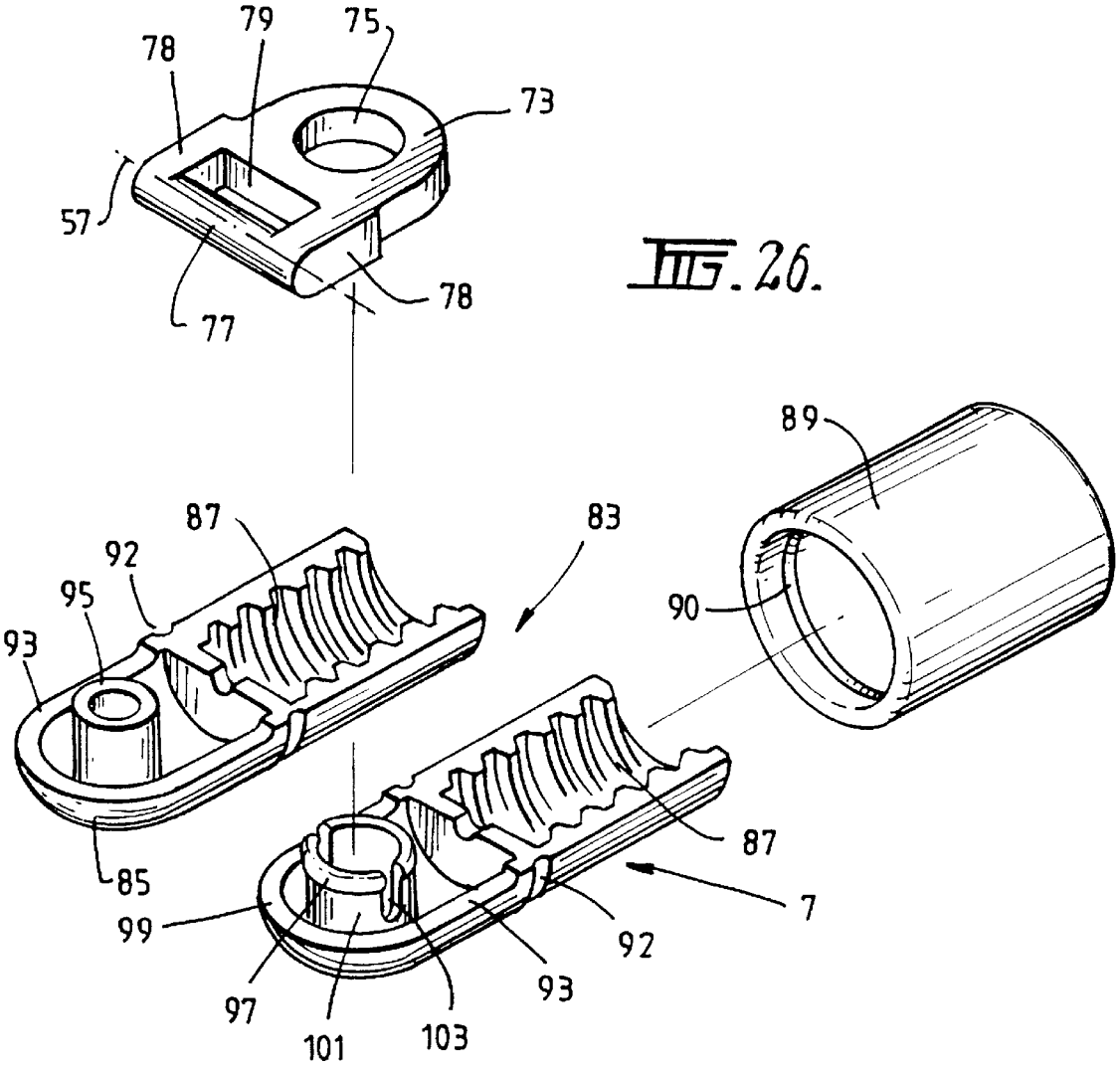
FIG. 26 is an exploded isometric view of the part shown in FIGS. 19 through 21 and 22 through 25.

The handle 3 has one end screw threaded to cooperate with the screw thread of the bore 87. Thus, when the handle 3 is tightly screwed into the bore 87 (as shown in FIG. 27) it causes the two halves to move radially outwardly into engagement with the internal surfaces of the collar 89 to assist in holding the handle screw fixed to the connector. This also, in turn, holds the first part 73 retained to the second part 83.

The mop head 5 has an intermediate portion 11, top cover part 105 which has a corresponding groove 107 to the groove 81, and the top cover part 105 is held to the intermediate portion 11 by a screw 109 (see FIG. 18). Thus, the grooves 81 and 107 hold the axle 77 of the first part 73 captive and provide bearing supports therefore for permitting rotation about the axis 57.

When the top cover part 105 is fitted to the intermediate portion 11, a tongue 117 at a forward end of the cover part 105 fits into an opening 119 in the intermediate portion 11. Thus, when the cover part 105 is fitted over the intermediate portion 11 and held thereto by the screw 109 passing through an aperture 121 in the intermediate portion 11, the cover 105 substantially hides the spring means 51 and the end portions 41 and 43 of the right hand arm portion 37 and left hand arm portion 39 of the second squeeze arm 29.

The tongue 117 provides location of and support for the cover part 105 at the front of the mop.

Half circular cut-outs 123 are provided in side portions 125 of the cover part 105 and these act to hold the end portions 41, 43 of the second squeeze arm 29 relative to the mop head 5. These cut-outs 123 ensure that the end portions 41 and 43 are maintained in the groove 81.

By inspecting FIG. 17 it can be seen that the cover 105 has an in-turned lip 129. This is also shown in FIG. 18. The cover 105 can be clipped over the intermediate portion in an hinging manner from one side as shown in FIG. 18 so that it can assume a correct position so that the fastening screw 109 can be passed through the aperture 121 to permit holding of the cover relative to the intermediate portion 11.

Figure 7:
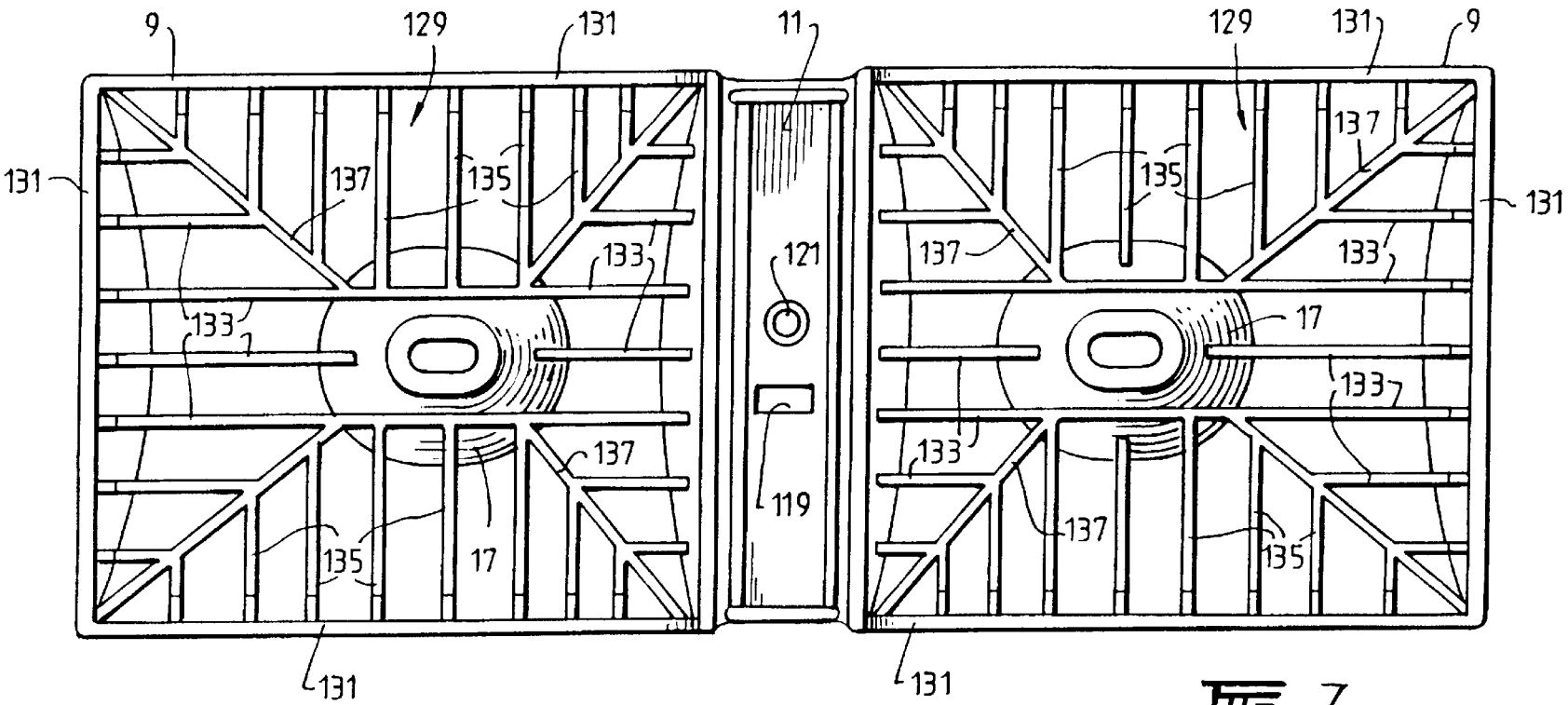
FIG. 7 is an underneath view of a mop head showing strengthening to inhibit against torsional twisting.

Referring now to FIG. 6 which is a perspective view of a prior art mop having two wings, and shown in the side-by-side relationship squeezing mop material, it can be seen that the second squeeze arm 29 applies a pressure from the first squeeze arm 27 via the external surfaces of the respective wings 9. The arrangement is such that there is an angle θ applied between the opposed faces of the mop material 13. This occurs because of the relatively low torsional rigidity of each of the wings 9 and because of the resultant forces of the mop material 13 acting to push the wings 9 apart. Ideally, in order to provide effective squeezing of the mop material 13, the wings 9 should not torsionally deflect as shown. In prior art mop heads the wings are usually made of a plastic material such as PVC. Longitudinally extending strengthening ribs are provided on the under surface of the wings 9 to provide lateral support during mopping when the wings are extended in a co-plannar arrangement. However, no consideration has been made to the torsional problem outlined above. We have determined that a plastics material mop head can be modified with strengthening ribs to alleviate the torsional problems of the prior art mop heads. In this connection, FIG. 7 shows an arrangement of ribs to alleviate this problem. The ribs 129 are provided on the under surface of the wings 9 and generally comprise an outer perimeter wall or rib 131, with longitudinally extending ribs 133, a series of other ribs 135 which extend transversely, and further ribs 137 which extend diagonally across opposite corners of each of the wings 9. The free end faces of these strengthening ribs define a surface for engaging with the mop material.

The shape of these strengthening ribs resists the torsional movement as exemplified in the prior art example of FIG. 6.

Figure 8:
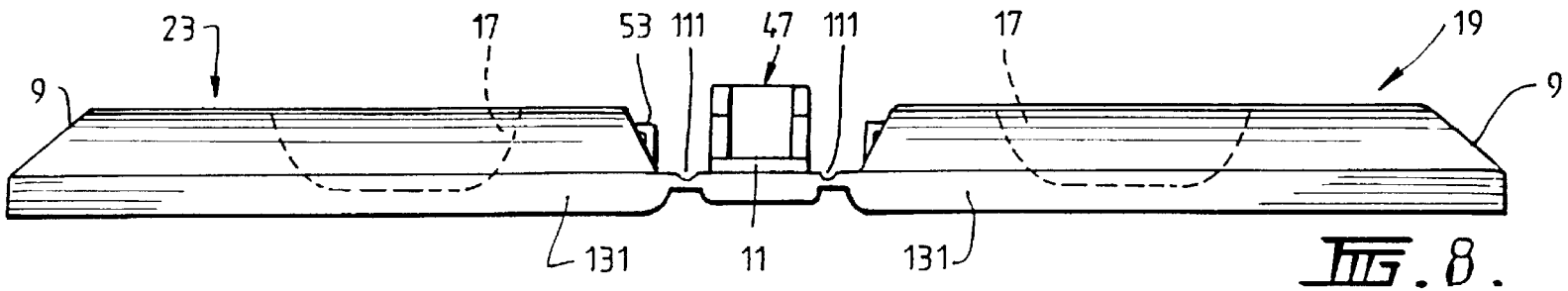
FIG. 8 is a rear isometric view of the mop head shown in FIG. 7.

FIG. 8 shows that each wing 9 has an upwardly raised upper surface which is provided with recessed cup-shaped depressions 17 to permit fastening of the mop material as explained previously and so that the retaining means such as nuts or studs will be below the upper-most level of the raised upper surface.

Figures 9, 10, 11:
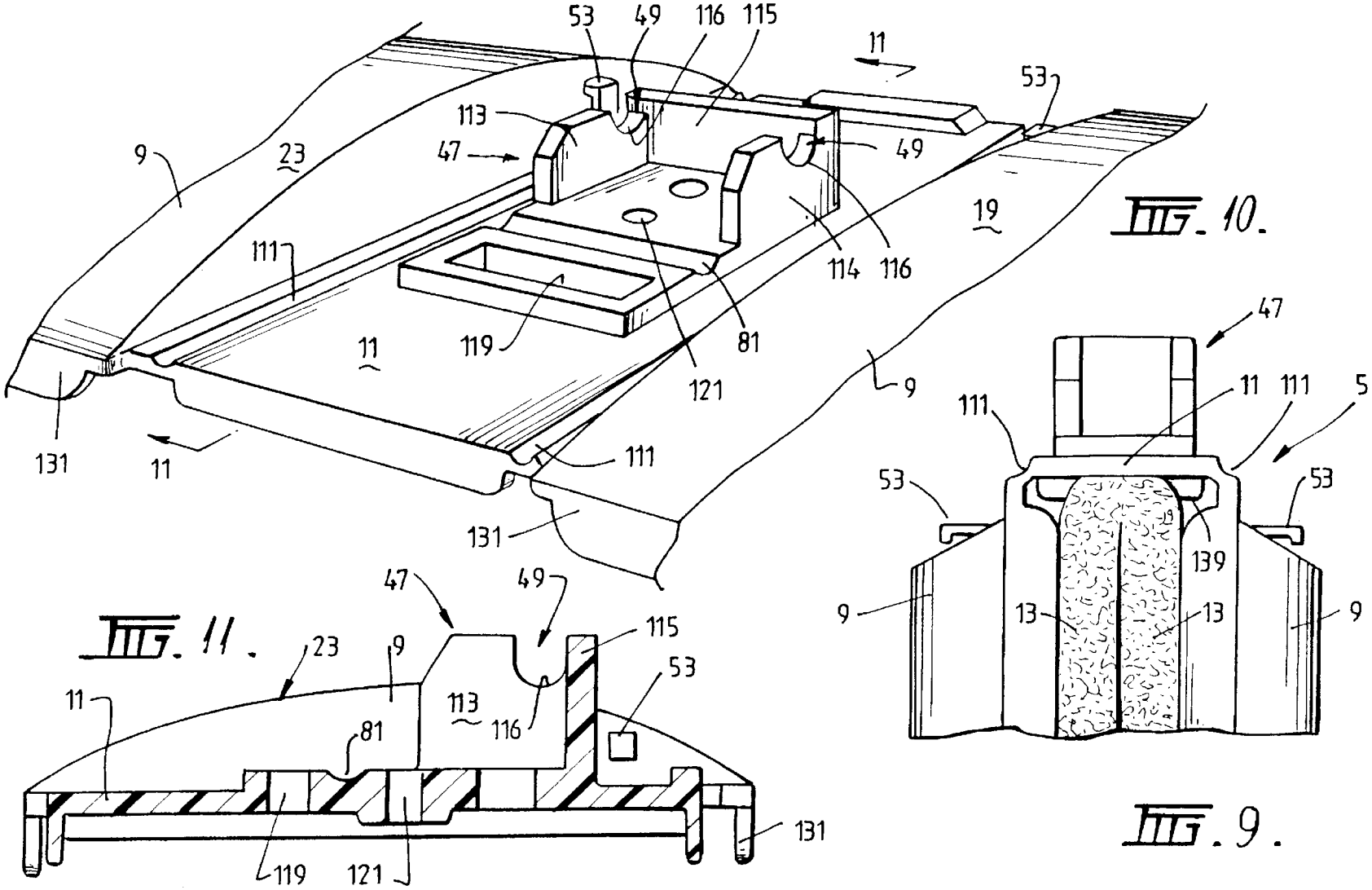
FIG. 9 is a detailed close up side view of the mop head showing squeezing of mop material.
FIG. 10 is a front isometric view in close up showing an intermediate part of the mop head.
FIG. 11 is a transverse cross-sectional view along section line 11—11 of FIG. 10.
Figure 12:
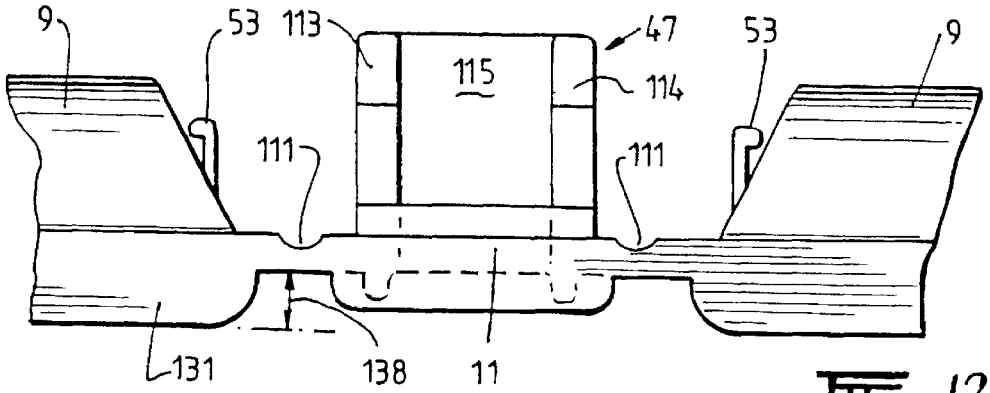
FIG. 12 is a detailed view of the intermediate portion from a back of the mop head.
Figure 13:
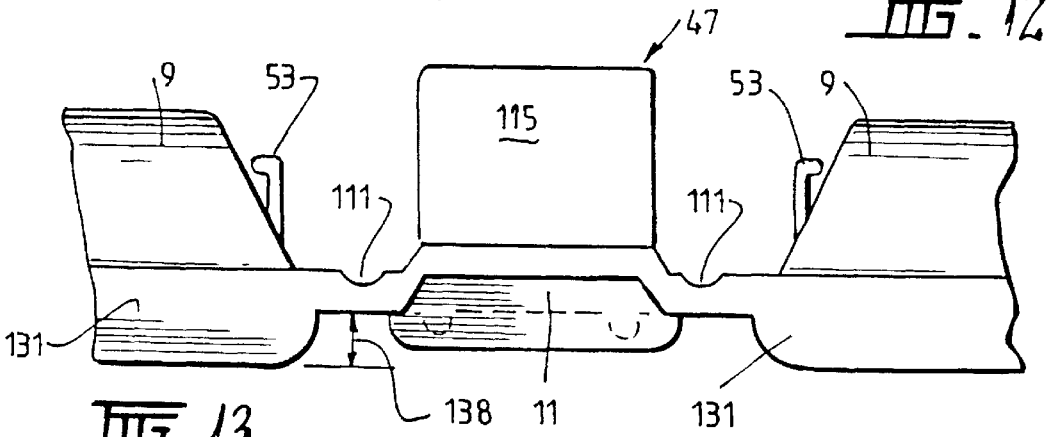
FIG. 13 is a view similar to that of FIG. 12 but from a front of the mop head.
Figure 14:
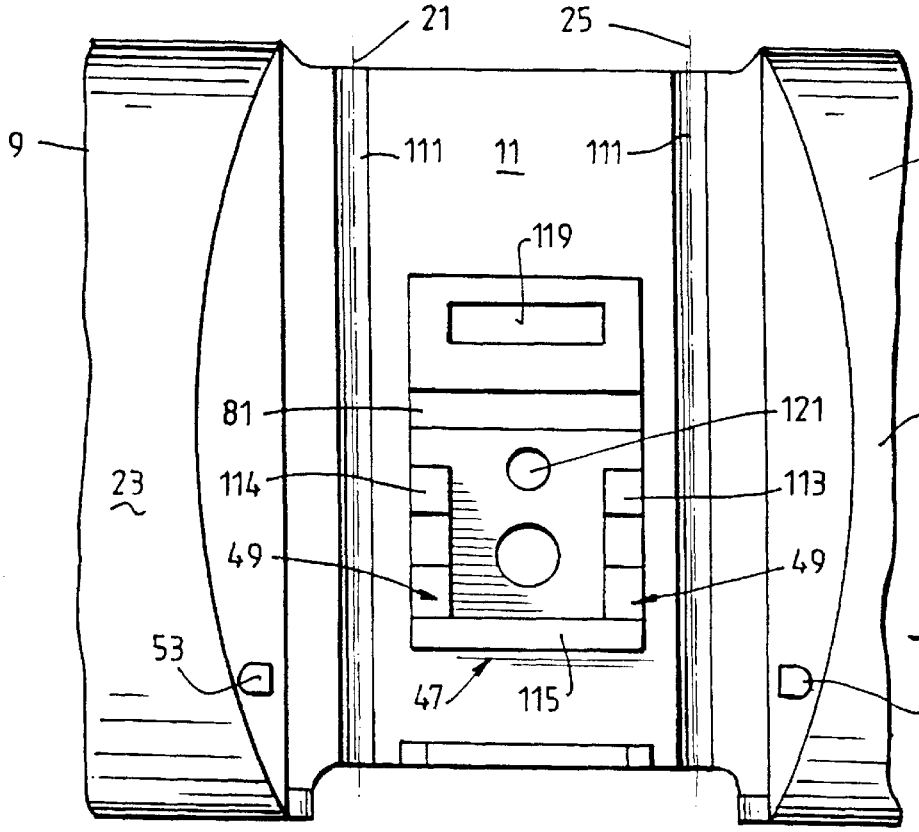
FIG. 14 is a plan view of the intermediate part of the mop head.

FIG. 9 shows an arrangement where the mop head 5 has the wings 9 swung to positions where they are in side-by-side arrangement and squeezing the mop material 13. It can be seen in FIGS. 12 and 13 that the undersurface of the intermediate mop head portion 11 is spaced away from the free end faces of the strengthening webs 133 through a distance 138. Thus, when the mop material, in the form of a synthetic foam mop, is attached to the mop head 5 it will not bear upon the undersurface of the intermediate mop head portion 11 when the wings 9 are co-plannar to one another in a mop, in use, position. This, in turn, provides a space 139 for the mop material 13 when the wings 9 are in the side-by-side relationship shown in FIG. 9. This, in turn, relieves pressure on the squeezing action of the mop material 13 as, otherwise, the mop material 13 would bunch up in the region of the intermediate portion 11 and resist closing of the wings 9 to squeeze the mop material.

It should therefore be seen that the axis 69, 67 and 57 are substantially parallel to one another. It should also be seen that the axis 59 and 65 are substantially parallel to one another and mutually perpendicular to the axis 69, 67 and 57. Thus, it can be seen that the first squeeze arm 27 has a first pivot axis 69 where it is retained to the handle 3 and the second squeeze arm 29 has a pivot axis where the end portions 41, 43 are retained to the intermediate portion 11.

It should also be noted that the pivot axis along the end portions 41, 43 is also parallel with the axis 57, 67 and 69. The central longitudinal axis of the portions 41, 43 is positioned forwardly of the axis 57 and therefore forward of the swivel connector 7.

By observing FIGS. 4 and 5 it can be seen that when pushing or pulling the mop handle 3, the mop head 5 tends to crank either clockwise or anticlockwise. FIG. 4 shows the situation where the mop handle 3 is pushed relative to the mop head 5 such that the mop head 5 travels forwardly over a surface being mopped. FIG. 5 shows the opposite where the mop handle 3 is pulled thus dragging the mop head 5 towards the operator of the mop. Thus, the mop head 5 tends to crank clockwise or anticlockwise. It has been found that if a frictional component is provided to swinging about at least one of the axis of the end portions 41, 43, axis 67, and axis 69, and also axis 57, that this cranking can be minimised. Preferably, the frictional component is at each of those axis although it appears that providing the component at axis 69 does not greatly assist in minimising the problem.

FIG. 1 shows that the intermediate, cover part 105 is held to the head 5 by a screw 109. Thus, tightening the screw 109 can cause increased frictional resistance to be applied to the axle 77 and or the end portions 41, 43 as the cover is drawn more tightly onto the head 5. It is also particularly preferred that the connector 63 has a tight frictional fit relative to the second squeeze arm 29 to apply frictional resistance to rotation about axis 67. It has been found that by providing frictional resistance to swinging about axis 67, that with only minimal frictional resistance applied at the other axis, the mop head 5 can be substantially inhibited from cranking in either clockwise or anticlockwise directions during normal mopping procedures. The exact amount of friction required is not clear but the swinging connection is such that to achieve this result there should be resistance which does not prevent free swinging of the first squeeze arm 27 relative to the second squeeze arm 29 unless considerable force is applied. The exact force is to be found by experimentation and moulding tolerances in the connector 63 relative to the second squeeze arm 29. It is noted that the connection for permitting swinging about axis 67 is a snap fitting connection. Thus, the tolerances are devised to provide for the necessary frictional resistance. It should be noted that the first squeeze arm 27 and the second squeeze arm 29 are produced from round galvanised steel rod.

Modifications may be made to the invention as would be apparent to persons skilled in the mop arts. These and other modifications are deemed within the scope of the invention the nature of which is to be determined by the aforegoing description.

What is claimed is:

1. A mop having an elongate handle, a mop head for carrying a squeezable pad mop material, said mop head being in at least two parts which can swing relative to one another so that in one swung condition the pad will be generally flat and unsqueezed and be useable as a mop, and in another swung condition so the pad will be squeezed, mop squeeze arm means carrying said mop head for causing said two parts to swing together between said one swung condition and said another swung condition, a swivel connector interconnecting said mop head and said handle, said swivel connector having two mutually perpendicular swivel axes to enable said mop head to assume various angular orientations relative to said handle whilst said pad is engaged on a surface to be mopped, stop means on said mop head for preventing swivel movement of said mop head relative to said handle past a particular orientation when said squeeze arm means is operated to squeeze said pad mop material thereby permitting pressure to be applied to said mop head by said squeeze arm means to effect swinging of said two parts and squeezing of said pad mop material.

2. A mop as claimed in claim 1 wherein said mop head has an axis of swinging of said two parts for permitting swinging which extends transverse to the direction of pulling or pushing of the mop head by the mop handle when the handle is orthogonal to the mop head, so that one of the two parts is a front part and the other part is then a rear part.

3. A mop as claimed in claim 1 wherein said mop head has an axis of swinging of said two parts for permitting swinging which extends generally in the direction of pushing or pulling of the mop handle so that one part is a wing which extends from a right hand side of the central axis of the mop handle and the other part is another wing which extends from the left hand side of the central axis of the mop handle when the handle is orthogonal to the mop head.

4. A mop having an elongated handle, a mop head for carrying a squeezable pad mop material, said mop having two wings supporting said pad, each of said wings being separated by an intermediate mop head portion, said wings being swingable relative to said intermediate mop head portion about respective axes that extend along respective sides of said intermediate mop head portion, said axes being parallel to one another and extending in a direction of intended pushing or pulling of said mop head by said handle when said handle is orthogonal to the mop head, the mop head being in a mop, in use, condition when the wings are open and generally co-planar, and in a pad squeezing condition when the wings are closed and side-by-side, spring means urging said wings to said co-planar, in use condition, a swivel connector interconnecting said intermediate portion and said handle maintaining said mop head connected to said handle, said swivel connector having two mutually perpendicular swivel axes to enable said mop head to assume various angular orientations relative to said handle whilst a mop face of said pad mop material is fully engaged on a surface to be mopped, said intermediate portion carrying stop means to prevent said mop head and said handle cranking past said stop means, said pad mop material being squeezable by operation of pushing a first squeeze arm towards said mop head, said first squeeze arm being retained at one end relative to said handle and being retained at the opposite end to a second squeeze arm, said second squeeze arm having a right hand arm and a left hand arm which respectively extend on the right hand side of said handle and the left hand side of said handle and pass over and contact tops of the corresponding wings of said mop head, said right hand arm and said left hand arm having respective end portions which are retained to said intermediate portion, said right hand arm, said left hand arm, and said end portions, acting to provide stops for said wings to maintain said wings in an open co-planar position against the urging by said-spring means, and when said first squeeze arm is pushed towards said mop head, said stop means will prevent cranking of said mop head relative to said handle past said stop means, pressure will then be applied by said right hand arm and said left hand arm to the tops of the respective wings against the urging of the spring means to close said wings to enable squeezing of said pad mop material, said first squeeze arm having a first pivot axis where it is retained to said handle, said second squeeze arm having a second pivot axis where said end portions are retained to said intermediate portion, said first and said second pivot axes being generally parallel to one another, said first squeeze arm and said second squeeze arm having two mutually perpendicular swivel axis connections where they are retained to each other, one of those axes being generally parallel to said first and said second pivot axes, the various axes being such that said right hand arm and said left hand arm and said end portions will hold the wings substantially co-planar regardless of the possible angular orientations assumed by the mop face of said pad mop material to said handle.

5. A mop as claimed in claim 4 wherein said end portions of said right hand arm and said left hand arm are retained to said intermediate portion at a position forward of connection of said swivel connector, relative to the direction of pushing of said mop head when the mop head is inclined for pushing.

6. A mop as claimed in claim 4 wherein said first squeeze arm is retained to said handle by a collar which is slideably carried on said handle, so that pushing or pulling said collar along said handle towards or away from said mop head will cause corresponding pushing or pulling of said first squeeze arm to effect respective closing or opening of said wings.

7. A mop as claimed in claim 4 wherein at least one of said first pivot axis, said second pivot axis, said one of said two axis connections of said first squeeze arm and said second squeeze arm, and the retaining connection where said end portions are retained to said intermediate mop head portion and allow relative rotation of said end portions relative to said intermediate portion, have a frictional component for swinging which will act against cranking forces tending to lift a front edge or a rear edge of the mop material from a surface which is being mopped as a result of pushing or pulling of the mop head handle, thereby attempting to maintain said mop surface substantially wholly in contact with said surface being mopped.

8. A mop as claimed in claim 7 wherein said frictional component is at said one axis of said two axes connections of said first squeeze arm and said second squeeze arm.

9. A mop as claimed in claim 7 wherein said frictional component is at said one axis of said two axes connections of said first squeeze arm and said second squeeze arm, at said second pivot axis.

10. A mop head for a pad mop material, said mop head having two wings for supporting said pad mop material, each of said wings being generally rectangular in shape and separated by an intermediate mop head portion, said wings being swingable relative to said intermediate mop head position about respective axes that extend along respective sides of said intermediate mop head portion, said axes being parallel to one another and extending in a direction of intended pushing or pulling of said mop head by a handle, the mop head being in a mop, in use, condition when the wings are open and generally co-planar, and in a pad mop material squeezing condition when the wings are closed and side-by-side, said mop head being of synthetic plastics material, each of said wings having a series of strengthening webs extending on an underside thereof so that the free end faces of said strengthening webs define a surface for engaging with said pad mop material, said webs being elongate, some extending perpendicular to said axes, some extending parallel to said axes and some extending diagonally across opposite corners of each of said wings.

11. A mop head as claimed in claim 10 wherein each wing has a peripherally extending wall which extends from the underside so that the free end faces of said wall are generally co-planar with the free end faces of said strengthening webs.

12. A mop head as claimed in claim 10 wherein an upper surface of each of said wings is upwardly raised and provided with a recessed cup shaped depression with an aperture permitting the passing of a mounting stud of the pad therethrough so that retaining means can be fitted over the mounting stud to hold the pad mop material to the mop uppermost level of the raised upper surface.

13. A mop head as claimed in claim 10 wherein the, undersurface of the intermediate mop head portion is spaced from the free end faces of the strengthening webs so that it will not touch the upper surface of said pad mop material when said wings are open and generally co-planar, thereby allowing a space for pad mop material to occupy when said wings are side-by-side in a pad mop material squeezing condition.

14. A mop head as claimed in claim 10 wherein said intermediate portion carries a swivel joint part of a swivel connector for permitting a handle to be connected to said mop head via said swivel connector.

15. A mop head as claimed in claim 14 wherein said intermediate portion carries a stop for inhibiting angular swivel swinging of said handle past a given angle where said handle is upright relative to said mop head.

* * * * *